United States Patent [19]

Ohki

[11] 4,215,254

[45] Jul. 29, 1980

[54] PRESSURE SWITCH WITH RESILIENTLY MOUNTED CONTACT

[75] Inventor: Nobuyoshi Ohki, Tokyo, Japan

[73] Assignee: Niles Parts Co., Ltd., Japan

[21] Appl. No.: 967,022

[22] Filed: Dec. 6, 1978

[30] Foreign Application Priority Data

May 4, 1978 [JP] Japan ..... 53-60975

[51] Int. Cl.[2] ..... H01H 35/32

[52] U.S. Cl. ..... 200/83 C; 200/83 J; 200/82 R; 200/246; 200/250

[58] Field of Search ..... 200/81 R, 83 R, 83 WM, 200/83 J, 83 C, 83 P, 83 S, 83 SA, 83 W, 241, 244, 249–251, 286, 290, 82 R, 239, 245, 246, 283, 257

[56] References Cited

U.S. PATENT DOCUMENTS

| | | | |
|---|---|---|---|
| 3,459,914 | 8/1969 | Gustavson | 200/245 |
| 3,683,137 | 8/1972 | Stiltner | 200/83 R |
| 4,049,935 | 9/1977 | Gruber | 200/83 P |
| 4,121,074 | 10/1978 | Orcutt | 200/83 P |

*Primary Examiner*—Gerald P. Tolin

*Attorney, Agent, or Firm*—Lane, Aitken & Ziems

[57] ABSTRACT

A high-quality pressure switch comprising a member moving according to pressure applied and a moving contact piece to act as a switch. The member has an end portion contained in a switch case to engage with said moving contact piece and remain in touch with a spring bearing and further a flanged portion contacting a stopper built in said switch case when a spring incorporated in said spring bearing is compressed by the end portion actuated by the travel of the member moving in a direction of a switch chamber when subjected to pressure. The moving contact is fitted with a moving contact on one end thereof and has the other end secured to a terminal elastically and in a freely movable condition to swing and move the moving contact piece pivoting on the end against the resilient force of spring according to the travel of said member, whereby said moving contact is separated from a fixed contact to switch off. The operating fulcrum of the moving contact piece is thus preferably supported in a freely movable state and further elastically, which frees the moving contact piece from bending and/or distorting stress working thereon when pressed excessively by the member.

6 Claims, 3 Drawing Figures

PRESSURE SWITCH WITH RESILIENTLY MOUNTED CONTACT

BACKGROUND OF THE INVENTION

1. Field of the Invention

The present invention relates to a pressure switch wherein a moving contact piece provided in a switch mechanism swings to engage and disengage the corresponding fixed contact for switching operation following the travel of a member moving in response to pressure applied (hereinafter referred to as a pressure-moved member).

2. Brief Description of the Prior Art

Pressure switches of the type available heretofore have been such that a moving contact piece provided in a switch mechnism was made of a conductive elastic piece, e.g. a leaf, spring or the like and the one end of said moving contact piece was secured and supported nonelastically to work as a swinging fulcrum.

However, these conventional pressure switches have incurred the following inconveniences.

Namely, the moving contact piece has swung and reset automatically with the self-retaining elasticity pivoting on the aforementioned one end thereof. However, the self-retaining elasticity has become poorer and poorer while being pressed repeatedly by the pressure-moved member for a long term and eventually resulted in the automatic swinging and resetting function mentioned above being lost practically.

In a pressure switch incorporating an ever-closed switch mechanism and being of such type that proper contact pressure of the corresponding contacts is assured by virtue of an elastic swinging and resetting force of the moving contact piece and that the corresponding contacts disengage in response to the contacting movement of pressure-moved member, there has been the possibility of failure to ensure adequate and sufficient contact making pressure because of substantial reduction in the self-retaining elasticity of said moving contact piece.

On the other hand, in a pressure switch enclosing an ever-open switch mechanism and being of such type that the moving contact piece swings to engage the corresponding fixed contact in response to the contacting travel of the pressure-moved member and that the moving contact piece swings to reset automatically with the self-retaining elasticity thereof to disengage the corresponding fixed contact in response to the returning travel of the pressure-moved member, the pressure switch has included the possibility that the moving contact piece fails to reset any more automatically as a result of the self-retaining elasticity thereof having nearly been lost and is left in touch with the corresponding fixed contacts. Problems can also arise where the moving contact happens to disengage the corresponding fixed contact at the moment of being subjected to vibration and/or shock, resulting in the switch no longer working normally. There is also another possibility that the moving contact piece may be bent or deformed by the overtravel of the pressure-moved member and result in the function provided as a pressure switch being spoiled.

SUMMARY OF THE INVENTION

It is an object of the present invention to provide a novel pressure switch constructed by connecting the one end of a moving contact piece to a terminal elastically with a spring or the like.

It is another object of the present invention to provide a pressure switch incorporating a moving contact piece which operates correctly with no performance cutback even though being pressed repeatedly by a pressure-moved member.

It is another object of the present invention to provide a pressure switch constructed so that a moving contact piece fitted with a moving contact can provide adequate and sufficient contact making pressure.

It is another object of the present invention to provide a pressure switch provided with a moving contact piece which swings to reset correctly according to the returning travel of the pressure-moved member.

It is another object of the present invention to provide a pressure switch negating totally the chance of maloperation even though being subjected to undue vibration and/or jar.

It is a still further object of the present invention to provide a pressure switch enclosing a moving contact piece substantially free of disadvantage such as bending or distortion even when a pressure-moved member makes excessive and repeated contacting travel.

DESCRIPTION OF THE PREFERRED EMBODIMENTS

An object of this invention is to eliminate the various shortcomings in the conventional pressure switches and there is given herein a detailed description of the embodiments of this invention.

Figure 1:
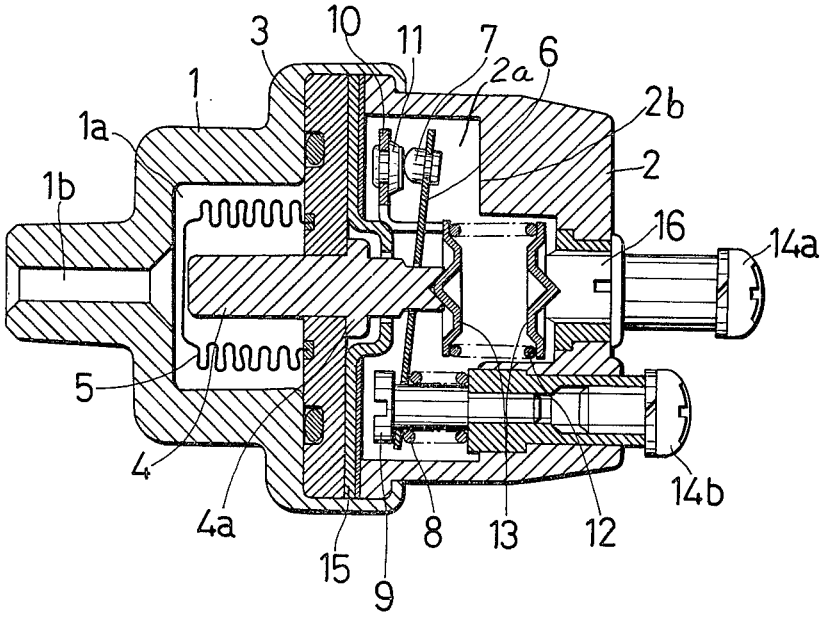
FIG. 1 shows a longitudinal sectional view of a first embodiment of the pressure switch of the present invention.

FIG. 1 shows the first embodiment of the pressure switch of the present invention incorporating an ever-closed switch mechanism.

1 is a switch case, 2 is a switch body and 3 is a partition plate secured between the switch case and the switch body. The switch case 1 substantially forms a pressure receiving chamber 1*a* and the switch body 2 forms a switch chamber 2*a* as well.

1*b* is a pressure drawing port provided to form a passage leading the pressure receiving chamber 1*a* of the switch case 1 toward the outside of the switch case 1.

4 is a member moving in response to pressure applied, i.e., a pressure-moved member which passes through the afore-said partition plate 3 and is supported in a freely movable condition. The one end thereof is protruding into the pressure receiving chamber 1*a* and the other end is butting out toward the interior of the switch chamber 2*a*. The one end of said pressure-moved member 4 is covered with a bellows 5 attached to the partition plate 3.

6 is a moving contact piece made substantially of a relatively solid conductive piece and fitted with a moving contact 7 at the one end. The other end is supported by a spring 8 in the switch chamber 2*a* so that it is freely movable in a direction similar to the travelling direction of the pressure-moved member 4 and further freely swingable elastically.

More particularly describing the construction of the swinging fulcrum at the other end of the aforementioned moving contact piece 6, the other end of said moving contact piece 6 is slideably supported by inserting through it a terminal 9 projecting out of the internal peripheral portion of the switch chamber 2*a* of the switch body 2, and said spring 8 is loaded between the internal peripheral portion of the switch chamber 2*a* and the other end of said moving contact piece 6.

The spring 8 is always working to energize the moving contact piece 6 in the direction of the pressure receiving chamber 1*a* and at the same time to swing the moving contact piece 6 pivoting the other end thereof in the direction of the pressure receiving chamber 1*a* . The other end of said pressure-moved member 4 is kept engaged with the middle portion of said moving contact piece 6.

10 is a fixed contact plate provided in the switch chamber 2*a* and fitted with a fixed contact 11 corresponding to the moving contact 7 of the moving contact piece 6. The corresponding moving contact 7 and the fixed contact 11 are kept in contact with each other by means of the spring 8.

12 is a spring loaded between the other end of the pressure-moved member 4 and the internal peripheral portion of the switch chamber 2*a*. And, between the one end of said spring 12 and the internal peripheral portion of the switch chamber 2*a* and further between the other end of said spring 12 and the other end of the pressure-moved member 4, a spring bearing 13 is put and retained. At the internal peripheral portion of the switch chamber 2*a* holding the spring bearing 13 opposite to the one end of said spring 12, the end portion of an adjusting thread 16 screwed in the switch body 2 from the outside is located. Moreover, the foregoing fixed contact plate 10 is led electrically toward the outside of the switch body 2 through a thread terminal 14*a* and similarly the moving contact piece 6 is led electically toward the outside of the switch body 2 by a thread terminal 14*b* via the terminal 9 and the spring 8.

Further, 15 in FIG. 1 is a stopper provided in the switch chamber 2*a* and works to prevent the pressure-moved member 4 from overtravelling in the direction of the switch chamber 2*a*. In other words, when said pressure-moved member 4 travels in the direction of the switch chamber 2*a* by a specified distance, a flanged portion 4*a* of the pressure-moved member 4 touches the stopper 15, thus restraining said pressure-moved member 4 from travelling in excess of the specified distance. The operation is described hereunder.

While pressure introduced through the pressure drawing port 1*b* of the switch case 1 remains unapplied to the interior of the pressure receiving chamber 1*a*, the pressure-moved member 4 is left pressed in the direction of the pressure receiving chamber 1*a* by virtue of the spring 12 and the flanged portion 4*a* of said pressure-moved member 4 is touching the partition plate 3.

Also in this case, as the moving contact piece 6 is still free completely from the thrust operation of the other end of the pressure-moved member 4, the moving contact 7 is held to engage the fixed contact 11 by the elastic force of the spring 8.

Therefore, while no pressure is working to the pressure receiving chamber 1*a*, an electric circuit (not indicated by the drawing) connected to the thread terminals 14*a* and 14*b* is in a closed condition.

Once a specified or more pressure is introduced into the pressure receiving chamber 1*a* through the pressure drawing port 1*b*, the pressure-moved member 4 is forced by pressure through the bellows 5 in the direction of the switch chamber 2*a* against the elastic force of the spring 12. The result is that the flanged portion 4*a* of said pressure-moved member 4 touches the stopper 15.

As the pressure-moved member 4 is thus actuated, the middle portion, which is kept engaged with the other end of the pressure-moved member 4, of the moving contact piece 6 is jerked accordingly and said moving contact piece 6 swings rightward in FIG. 1 pivoting the other end thereof against the elastic force of the spring 8, whereby the moving contact 7 is separated from the fixed contact 11.

The result is that the electric circuit (not indicated by the drawing) connected to the thread terminals 14*a* and 14*b* opens.

Further, in such a case, too that the pressure-moved member 4 overtravels in the direction of the switch chamber 2*a* because of unusually heavy pressure having been applied to the pressure receiving chamber 1*a* through the pressure drawing port 1*b*, the same operation as in the foregoing is made, viz. the moving contact piece 6 first swings rightward pivoting on the other end thereof and the moving contact 7 fitted to the one end thereof disengages the fixed contact 11 and thereafter, the one end of said moving contact piece 6 touches a wall portion 2*b* of the switch chamber 2*a* opposite to the contact piece 6 in the travelling direction of the pressure-moved member 4 and the other end of the moving contact piece 6 is pressure-moved in the travelling direction of said pressure-moved member 4 against the spring 8.

Therefore, even if the pressure-moved member 4 overtravels toward the switch chamber 2*a*, there is no case where the middle portion of the moving contact piece 6 is bent or distorted unnecessarily.

Moreover, once pressure to the pressure receiving chamber 1*a* falls below that specified, the pressure-moved member 4 is actuated in the direction of the pressure receiving chamber 1*a* by the resilience of the spring 12 and said pressure-moved member 4, the bellows 5 and the moving contact piece 6 return to their respective original states which were being maintained before the pressure receiving chamber 1*a* was pressurized and the moving contact 7 engaged the fixed contact 11. Thus, the original switch condition is recovered.

Figure 2:
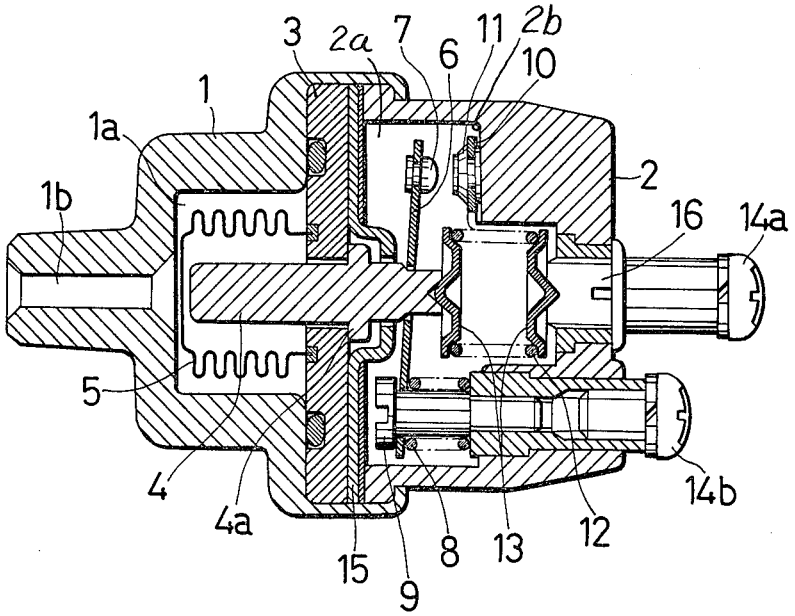
FIG. 2 is a longitudinal sectional view of a second embodiment of the pressure switch of the present invention.
Figure 3:
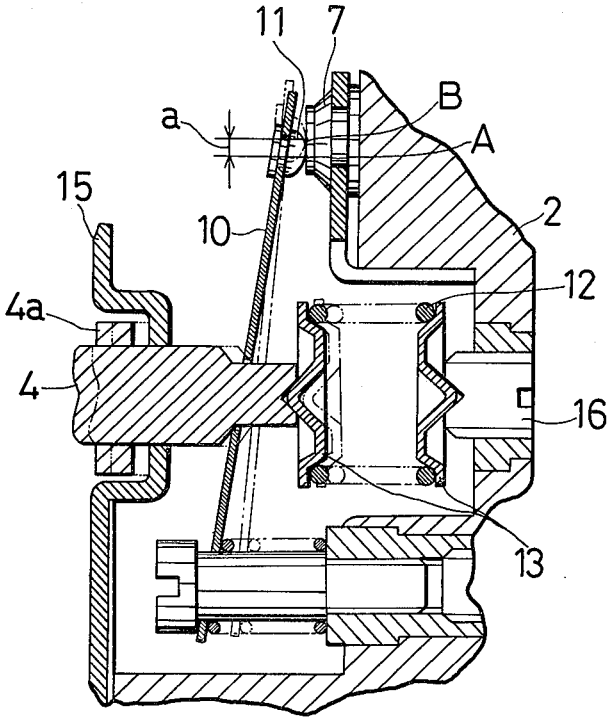
FIG. 3 is a fragmentary expanded sectional view illustrating the operation of the second embodiment of pressure switch of the present invention.

Then, the electric circuit connected to the thread terminals 14*a* and 14*b* is of course re-closed. Furthermore, the intensity of pressure applied to the pressure receiving chamber 1*a*, which is necessary for swinging the moving contact piece 6 to separate the moving contact 7 from the fixed contact 11, is determined by the self-resilience of the spring 12 providing a moving resistance in the travel of the pressure-moved member 4. Besides, the pressure is freely regulatable by adjusting the compressive force of the spring 12 by operating the adjusting thread 16 screwed in the switch body 2. FIG. 2 and FIG. 3 show the second embodiment of pressure switch of this invention, wherein an ever-open switch mechanism is contained. The fixed contact 11 attached onto the fixed contact plate 10 in the foregoing first embodiment is mounted on the wall portion 2*b* of the switch chamber 2*a* which is opposite to the one end of the moving contact piece 6 in the travelling direction of the pressure-moved member 4 and further, the moving contact 7 is arranged to correspond to the fixed contact 11 on said wall portion 2*b*. The construction of other parts is the same as in the first embodiment described hereinbefore. In the second embodiment, usually while no pressure is present in the pressure receiving chamber 1*a*, the moving contact piece 6 is disengaged from and opposite to the fixed contact 11 with some space and accordingly the moving contact 7 on the moving contact piece 6 is also off the fixed contact. Thus, said moving contact 7 and the fixed contact 11 form an ever-open switch mechanism. Moreover, once a specified or more pressure is applied to the pressure receiving chamber 1*a*, the pressure-moved member 4 is forced by pressure through the bellows 5 in a direction of the switch chamber 2*a* against the resilience of the spring 12 and the moving contact piece 6 swings pivotally on the spring 12. This operation is similar to that in the foregoing first embodiment.

In this second embodiment, the swinging operation of the moving contact piece 6 causes the moving contact 7 fitted thereto to engage the fixed contact 11. Then, the electric circuit (not indicated by the drawing) connected to the thread terminals 14*a* and 14*b* is closed naturally. On the contrary, once pressure to the pressure receiving chamber 1*a* decreases below that specified, the pressure-moved member 4 is actuated in the direction of the pressure receiving chamber 1*a* by the resilient force of the spring 12 and said pressure-moved member 4, the bellows 5 and the moving contact piece 6 return to their original conditions which were being maintained before the pressure receiving chamber 1*a* was pressurized.

This is also the same as in the first embodiment mentioned before. In this second embodiment, the moving contact 7 disengages the fixed contact 11 as the moving contact piece 6 swings to reset, and the electric circuit (not indicated by the drawing) connected to thread terminals 14*a* and 14*b* is put in re-opened condition.

The following operation is also the same as in the foregoing first embodiment. Namely, when the pressure-moved member 4 overtravels in the direction of the switch chamber 2*a* as a result of unusually heavy pressure having been applied to the pressure receiving chamber 1*a*, the other end of the moving contact piece 6 is forced to move in the travelling direction of the pressure-moved member 4 against the resilience of the spring 8. Even in such a case, however, none of bending or distorting stress works on the middle portion of the moving contact piece 6. Moreover, the intensity of pressure applied to the pressure receiving chamber 1*a*, which is necessary for actuating the switch mechanism, is freely settable through the adjusting thread 16.

This second embodiment is endowed with a special operation that the moving contact 6 wipes the surface of the fixed contact 11 during on-and-off operation of both contacts. Such operation is not included in the first embodiment. Describing the operation in a concrete form, it is as follows. In the operating process of the moving contact piece 6 which swings according to the travel of the pressure-moved member 4 under the condition where a specified or more pressure is applied to the pressure receiving chamber 1*a*, the moving contact 7 first comes in touch with a point A placed on the fixed contact 11 as shown by solid line in FIG. 3 and thereafter the other end of the moving contact piece 6 is journaled in the travelling direction of the pressure-moved member 4 along the terminal 9 as shown by the phantom lines in FIG. 3. At the same time, said moving contact piece 6 slides only the distance a in FIG. 3 on the fixed contact 11.

In accordance with the sliding operation of the moving contact piece 6 for the distance a, the moving contact 7 moves while wiping, from the position A to the position B, the fixed contact 11. Thus, the moment the moving contact 7 engages the fixed contact 11, wiping movement of the moving contact 7 is accomplished from the position A to B on the fixed contact 11 by the distance a.

Also, once pressure to the pressure receiving chamber 1*a* falls below that specified and the moving contact 7 disengages the fixed contact 11, the moving contact piece 6 acts opposite to the abovementioned viz. The moving contact 7 moves back while wiping from the position B to A on the fixed contact 11 by the distance a.

Although the illustrative first and second embodiments of the pressure switch of this invention has a construction that the other end of the pressure-moved member 4 is covered with the bellows 5 inside the pressure receiving chamber 1*a*, the invention is not limited to those embodiments having such construction. The pressure switch may be so constructed as to cover the pressure-moved member with a member transformed by pressure, e.g. a diaphragm and also, the pressure-moved member 4 per se may be formed directly with such a pressure-transformed member as a bellows and/or diaphragm.

Further, a switch mechanism provided in the switch chamber 2*a* may be constructed by combining ever-closed and ever-open switch mechanisms.

The embodiments of this invention have the abovementioned construction and operation and provide the following effects. Since the moving contact piece is formed substantially with a relatively solid conductive member, there is no possibility of bending or distortion occurring in the moving contact piece in constant year-round operation even if it is pressed repeatedly by the pressure-moved member and further, it is greatly durable in repeated switching operation.

As the swinging fulcrum of the moving contact piece is kept substantially in a freely movable condition yet elastically biased on the terminal and spring, no deflecting and deforming stress works on said moving contact piece even if it is pressed excessively by the pressure-moved member, thus eliminating the possibility of bending.

In addition, because of the pressure switch being substantially so constructed as to allow the fulcrum of the moving contact piece to move freely, wiping movement is made between the corresponding contacts in the switch mechanism during on-and-off operation and the result is that unnecessary substances including oxide, sulfide, carbide, dust, etc. generated and sticking to the contact faces can be removed, thereby making possible to always keep the contact resistance of these contacts at the minimum.

There is a further effect that the switch mechanism is applicable to pressure switches adapted to detect water pressure, oil pressure and other pressure.

What is claimed is:

1. A pressure switch comprising:

a member movable in response to pressure applied to the switch;

a fixed contact;

a substantially solid contact piece swingable to engage and disengage said fixed contact in response to the movement of the movable member;

a post;

said swingable contact piece having two ends, contact means being mounted adjacent one end and said swingable contact piece being slidably mounted adjacent its other end on said post; and means for biasing said swingable contact piece toward an end of said post, whereby said swingable contact piece is swingable about its said other end; and further comprising a bellows for transmitting to the moveable member the pressure applied to the switch.

2. The pressure switch according to claim 1 wherein the post is a terminal of the switch.

3. The pressure switch according to claim 1 wherein the biasing means is slidably mounted on said post.

4. The pressure switch according to claim 1 wherein the swingable contact piece is supported by the biasing means.

5. The pressure switch according to claim 1 further comprising a switch body, said fixed contact being mounted on said switch body.

6. The pressure switch according to claim 1 further comprising a partition member and a stopper, through both of which said movable member passes, said movable member having a flanged portion positioned between and engageable with said partition member and said stopper, whereby the movement of said movable member is limited.

* * * * *